US008807034B2

(12) United States Patent
LeFevre et al.

(10) Patent No.: US 8,807,034 B2
(45) Date of Patent: Aug. 19, 2014

(54) METHOD AND APPARATUS FOR SPREADER NIP BALANCING IN A PRINT SYSTEM

(75) Inventors: Jason Matthew LeFevre, Penfield, NY (US); David P. VanBortel, Victor, NY (US)

(73) Assignee: Xerox Corporation, Norwalk, CT (US)

( * ) Notice: Subject to any disclaimer, the term of this patent is extended or adjusted under 35 U.S.C. 154(b) by 162 days.

(21) Appl. No.: 13/446,576

(22) Filed: Apr. 13, 2012

(65) Prior Publication Data

US 2013/0269555 A1 Oct. 17, 2013

(51) Int. Cl.

| | |
|---|---|
| ***B41F 5/00*** | (2006.01) |
| ***B41F 7/02*** | (2006.01) |
| ***B41F 1/54*** | (2006.01) |
| ***B41F 1/56*** | (2006.01) |
| ***B41L 39/00*** | (2006.01) |
| ***B41L 47/56*** | (2006.01) |

(52) U.S. Cl.
USPC ..... 101/484; 101/216; 101/218

(58) Field of Classification Search
USPC ..... 101/216, 480, 484, 485, 218, 247; 347/101
See application file for complete search history.

(56) References Cited

U.S. PATENT DOCUMENTS

| | | | | |
|---|---|---|---|---|
| 5,588,362 | A * | 12/1996 | Sugiyama et al. | 101/218 |
| 6,659,152 | B1 * | 12/2003 | Miyake | 156/555 |
| 7,151,248 | B2 * | 12/2006 | Harush et al. | 250/221 |
| 7,367,733 | B2 * | 5/2008 | Bedzyk et al. | 400/625 |
| 7,866,262 | B2 * | 1/2011 | Seyfried | 101/488 |
| 8,028,623 | B2 * | 10/2011 | Takenouchi et al. | 101/352.02 |
| 8,302,555 | B2 * | 11/2012 | Nakazawa et al. | 118/262 |
| 8,408,123 | B2 * | 4/2013 | Novak et al. | 101/216 |

* cited by examiner

*Primary Examiner* — Jill Culler
*Assistant Examiner* — Leo T Hinze
(74) *Attorney, Agent, or Firm* — Ronald E. Prass, Jr.; Prass LLP

(57) ABSTRACT

An approach is provided for balancing a pressure profile of a spreader nip formed by a first roller and a second roller within a print system. A line parallel to a target process direction is determined. One of an inboard side and an outboard side of the spreader nip is loaded with a first variable force. The other one of the inboard side and the outboard side of the spreader nip is loaded with a second variable force. The inboard side and the outboard side of the spreader nip are then separately loaded by a first balancing force and a second balancing force to cause a substrate passing through the spreader nip to track in a direction such that a side edge of the substrate remains parallel to the line parallel to the target process direction.

10 Claims, 6 Drawing Sheets

METHOD AND APPARATUS FOR SPREADER NIP BALANCING IN A PRINT SYSTEM

FIELD OF DISCLOSURE

The disclosure relates to an apparatus and method for balancing a pressure profile in a spreader nip within a print system.

BACKGROUND

Print systems conventionally include a spreader nip for spreading ink applied to a substrate during a printing process. When feeding a substrate through the spreader nip, the spreader nip often forms a non-symmetric pressure profile across its width. This non-symmetric, or unbalanced, pressure profile in the spreader nip causes the substrate to be misaligned as it is fed through the spreader nip, and causes an uneven pressure to be applied to the substrate when it is in the spreader nip such that the ink applied to the substrate is unevenly spread.

Conventional methods for balancing the pressure profile in the spreader nip are considered to be open-loop solutions that are sensitive to the geometry of the spreader nip. Accordingly, every time any aspect of the geometry of the spreader nip changes, any load balancing equations or determinations for causing a balanced pressure profile must be reevaluated by way of extensive simulation and testing.

SUMMARY

Therefore, there is a need for an approach for balancing the pressure profile of a spreader nip in a manner that is closed-loop and insensitive to spreader nip geometry.

According to one embodiment, a method for balancing a pressure profile of a spreader nip formed by a first roller and a second roller within a print system comprises determining a line parallel to a target process direction. The method also comprises determining the presence of a substrate positioned between the first roller and the second roller in the spreader nip. The method further comprises causing, at least in part, one of an inboard side and an outboard side of the spreader nip to be loaded with a first variable force. The method additionally comprises causing, at least in part, the substrate to be fed through the spreader nip while the one of the inboard side and the outboard side of the spreader nip is loaded with the first variable force. The method also comprises causing, at least in part, the first variable force to increase as the substrate is fed through the spreader nip. The method further comprises determining, by way of a sensor, the substrate is caused to track to one of the inboard side and the outboard side of the spreader nip as the first variable force is caused to increase. The method additionally comprises determining a first biasing force to be equal to a value of the first variable force that causes the substrate to track to the one of the inboard side and the outboard side of the spreader nip.

Method also comprises causing, at least in part, the other one of the inboard side and the outboard side of the spreader nip to be loaded with a second variable force. The method further comprises causing, at least in part, the substrate to be fed through the spreader nip while the other of the inboard side and the outboard side of the spreader nip is loaded with the second variable force. The method additionally comprises causing, at least in part, the second variable force to increase as the substrate is fed through the spreader nip. The method also comprises determining, by way of the sensor, the substrate is caused to track to the other of the inboard side and the outboard side of the spreader nip as the second variable force is caused to increase. The method further comprises determining a second biasing force to be equal to a value of the second variable force that causes the substrate to track to the other of the inboard side and the outboard side of the spreader nip.

The method additionally comprises determining a first balancing force based, at least in part, on the first biasing force. The method also comprises determining a second balancing force based, at least in part, on the second biasing force. The method further comprises causing, at least in part, the inboard side of the spreader nip to be loaded by one of the first balancing force and the second balancing force and the outboard side of the spreader nip to be loaded by the other of the first balancing force and the second balancing force to cause the substrate to track in a direction such that a side edge of the substrate is caused to track parallel to the line parallel to the target process direction.

According to another embodiment, an apparatus for balancing a pressure profile of a spreader nip formed by a first roller and a second roller within a print system comprises at least one processor, and at least one memory including computer program code for one or more programs, the at least one memory and the computer program code configured to, with the at least one processor, cause the apparatus to determine a line parallel to a target process direction. The apparatus is also caused to determine the presence of a substrate positioned between the first roller and the second roller in the spreader nip. The apparatus is further caused to cause, at least in part, one of an inboard side and an outboard side of the spreader nip to be loaded with a first variable force. The apparatus is additionally caused to cause, at least in part, the substrate to be fed through the spreader nip while the one of the inboard side and the outboard side of the spreader nip is loaded with the first variable force. The apparatus is also caused to cause, at least in part, the first variable force to increase as the substrate is fed through the spreader nip. The apparatus further caused to determine, by way of a sensor, the substrate is caused to track to one of the inboard side and the outboard side of the spreader nip as the first variable force is caused to increase. The apparatus is additionally caused to determine a first biasing force to be equal to a value of the first variable force that causes the substrate to track to the one of the inboard side and the outboard side of the spreader nip.

The apparatus is also caused to cause, at least in part, the other one of the inboard side and the outboard side of the spreader nip to be loaded with a second variable force. The apparatus is further caused to cause, at least in part, the substrate to be fed through the spreader nip while the other of the inboard side and the outboard side of the spreader nip is loaded with the second variable force. The apparatus is additionally caused to cause, at least in part, the second variable force to increase as the substrate is fed through the spreader nip. The apparatus is also caused to determine, by way of the sensor, the substrate is caused to track to the other of the inboard side and the outboard side of the spreader nip as the second variable force is caused to increase. The apparatus is further caused to determine a second biasing force to be equal to a value of the second variable force that causes the substrate to track to the other of the inboard side and the outboard side of the spreader nip. The apparatus is additionally caused to determine a first balancing force based, at least in part, on the first biasing force. The apparatus is also caused to determine a second balancing force based, at least in part, on the second biasing force. The apparatus is further caused to cause, at least in part, the inboard side of the spreader nip to be loaded by one of the first balancing force and the second balancing force and the outboard side of the spreader nip to be loaded by the other of the first balancing force and the second balancing force to cause the substrate to track in a direction such that a side edge of the substrate is caused to track parallel to the line parallel to the target process direction.

Exemplary embodiments are described herein. It is envisioned, however, that any system that incorporates features of any apparatus, method and/or system described herein are encompassed by the scope and spirit of the exemplary embodiments.

BRIEF DESCRIPTION OF THE DRAWINGS

The embodiments of the invention are illustrated by way of example, and not by way of limitation, in the figures of the accompanying drawings.

DETAILED DESCRIPTION

Examples of a method and apparatus for balancing the pressure profile of a spreader nip in a manner that is closed-loop and insensitive to spreader nip geometry are disclosed. In the following description, for the purposes of explanation, numerous specific details are set forth in order to provide a thorough understanding of the embodiments of the invention. It is apparent, however, to one skilled in the art that the embodiments may be practiced without these specific details or with an equivalent arrangement. In other instances, well-known structures and devices are shown in block diagram form in order to avoid unnecessarily obscuring the embodiments.

As used herein, the terms "inboard" and "outboard" refer to opposing sides of a substrate. For example, if a sheeted or webbed substrate is viewed from above, the inboard side may refer to the left side of the substrate while the outboard side may refer to the right side of the substrate. However, it should be noted that the inboard side an outboard side may be interchangeable. As such, if the right side of the substrate is considered to be the inboard side, then the left side of the substrate is the outboard side. It accordingly follows, that if a top side of the substrate is considered to be the inboard side, then the bottom side is the outboard side, and if the bottom side of the substrate is considered to the be inboard side, then the top side of the substrate is the outboard side of the substrate.

Figure 1:
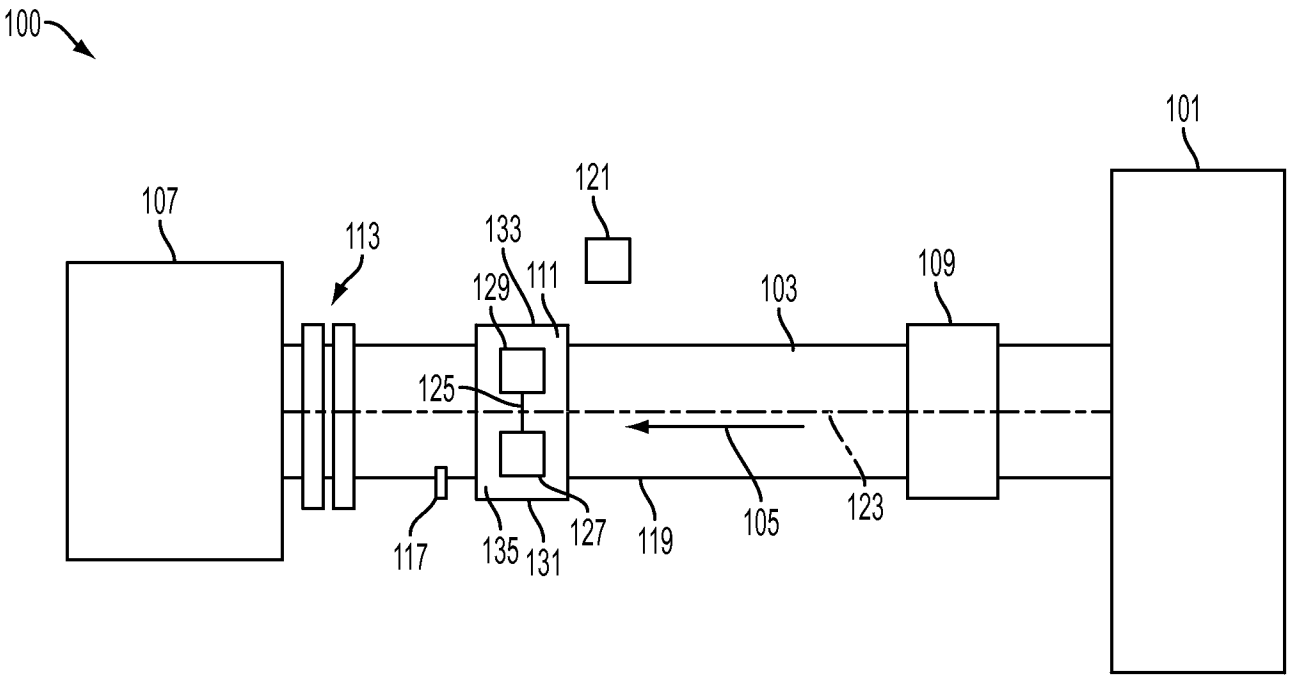
FIG. 1 is a top-view diagram of a system capable of balancing the pressure profile of a spreader nip in a manner that is closed-loop and insensitive to spreader nip geometry, according to one embodiment.

FIG. 1 is top-side view of a system capable of balancing the pressure profile of a spreader nip in a manner that is closed-loop and insensitive to spreader nip geometry, according to one embodiment. Print systems conventionally include a spreader nip for spreading ink applied to a substrate during a printing process. Conventionally, a spreader subsystem that includes the spreader nip is comprised of a spreader drum in contact, or positioned near, a pressure roll. The spreader drum often comprises a hard aluminium anodized surface or other hard surface, for example, while the pressure roll often comprises a steel core with an elastomeric coating or, in other words, a softer roll surface than that of the spreader drum, for example.

The spreader drum and pressure roll are loaded together (conventionally by about 6000 lbs of force total) to form the spreader nip either by applying a pressure between them as they contact one another or such that they do not contact one another, but leave just enough space for a substrate to pass through them while delivering a desired peak spreader nip pressure (conventionally about 1500 psi, for example).

The conventional spreader nip is about 0.275" to 0.315" thick in a process direction when formed. Conventional spreader subsystems comprise two means for applying the above mentioned load to induce the spreader nip pressure (one located at an inboard side of the spreader nip and one located at an outboard side of the spreader nip). Example means for inducing the spreader nip pressure may be, for example, air-bladders, screws, hydraulic means, stepper or servo motors, or any other means that may be controlled to cause a force to be applied to a pressure roll loading frame, for example, which in-turn causes the pressure roll to engage the spreader drum or the substrate to form the spreader nip.

When feeding a substrate, which may be a web-type substrate that is fed from a substrate supply roll or a sheeted substrate, through the spreader nip—the spreader nip often forms a non-uniform/unbalanced pressure profile across its width. The width of the spreader nip may be measurable in a direction that intersects the above-mentioned process direction. This non-uniform/unbalanced pressure profile in the spreader nip causes the substrate to be misaligned as it is fed through the spreader nip, and causes an uneven pressure to be applied to the substrate when it is in the spreader nip such that the ink applied to the substrate is unevenly spread. Maintaining a uniform pressure profile in the spreader nip is essential for ensuring the integrity of the substrate's tracking stability in the print system, as well as for delivering uniform ink squish or spreading.

Conventional methods for balancing the pressure profile in the spreader nip are considered to be open-loop solutions that are sensitive to the geometry of the spreader nip. Accordingly, every time any aspect of the geometry of the spreader nip changes, any load balancing equations or determinations for causing a balanced pressure profile must be reevaluated by way of extensive simulation and testing.

For example, launch intent spreader hardware for a print system allows the inboard and outboard balance of the loading mechanism to be independently controlled. This control is critical for adjusting the loading to meet the needs of the media with respect to two variables: (1) edge registered position and (2) absolute media width.

Conventionally, the spreader nip input load balance values for the above discussed inboard and outboard loading are determined and maintained using a set of equations derived from extensive modeling and testing. The modeling is complex and is based on the edge registered position and the absolute media width discussed above. In other words, as a media width changes, the applicable loads for the inboard and outboard sides of the spreader nip must be changed, as well as if an edge position is caused to change. But, if any geometry of the spreader nip changes, it is these equations that require continual updating. For example, if the pressure roll or the spreader drum experience thermal expansion or contraction, or if the spreader nip for some reason is caused to change in width, the modeling must be re-run to determine the appropriate loads for the inboard and outboard loads such that the spreader nip pressure profile is uniform across its width.

To address this problem, a system 100 of FIG. 1 introduces the capability to balance a pressure profile of a spreader nip in a manner that is closed-loop and insensitive to spreader nip geometry. The system 100 comprises a print tower 101 that applies an ink image to a substrate 103. The substrate 103 may be any of a webbed substrate or a sheeted substrate. The substrate 103 moves in a process direction 105 from the print tower 101 to a winder/stacker 107 where the substrate 103 is made ready for finishing as a rolled substrate or a stacked substrate, for example. En route to the winder/stacker 107, the substrate 103 passes through a leveler 109, a spreader system 111, and a series of exit rollers 113. While the system 100 includes a leveler 109, in this embodiment, various alternative embodiments may be directed to a fuser apparatus that excludes the leveler 109, for example. As such, the spreader system 111 may be configured to fuse an image to the substrate 103 additionally, or alternatively, to merely spreading ink that has been applied to the substrate 103.

In one or more embodiments, the system 100 comprises a single media edge position sensor 117. Though illustrated as a single sensor, the system 100 may include multiple media edge position sensors 117 that may confirm any information detected by another media edge position sensor 117, act as a backup for another media edge position sensor 117, for example. The media edge position sensor 117 is configured to detect a position or distance of an edge 119 (which may be any of an inboard side edge or outboard side edge) of the substrate 103 from itself. The media edge position sensor acts as a feed-back sensor for a control-loop that determines if the loading of the spreader nip results in a pressure profile that is balanced. It should be noted that while the media edge position sensor 117 is illustrated as being positioned between the spreader system 111 and the exit rollers 113, the media edge position sensor 117 may be positioned anywhere in the print system such that the media edge position sensor 117 may detect a position or distance between the edge 119 of the substrate 103 and itself. For example, the media edge position sensor 117 may be positioned on the inboard or outboard side of the system 100, within the spreader system 111, between the print tower 101 and the spreader system 111, etc.

The system 100 also comprises a controller 121 that is either integrated into the system 100 and hardwired to operatively communicate with one or more other components of the system 100, or is configured to communicate wirelessly with one or more other components of the system 100. In one or more embodiments, the controller 121 may be configured to determine a centerline 123 of the process direction 105 and determine a distance between the edge 119 of the substrate 103 and the centerline 123. The controller 121 may also be configured to determine one or more dimensions of the substrate 103, for example a width of the substrate 103 and/or a length of the substrate 103. Based on the determined dimensions of the substrate 103 and the detected distance of the edge 119 of the substrate 103 provided by the media edge position sensor 117, the controller 121 may determine whether the substrate 103 is offset from the centerline 123 when the substrate 103 moves in the process direction 105, or if the substrate 103 is fed through the spreader system 111 such that is it centered along the centerline 123 as the substrate 103 is fed in the process direction through the spreader system 111. If the substrate 103 is determined to be offset from the centerline 123, the controller 121 may determine a different centerline that the substrate 103 is to be aligned with to be one that is offset from the centerline 123 based, at least in part, on the one or more one or more dimensions of the substrate 103.

Additionally, or alternatively, as the media edge position sensor 117 provides detected position data to the controller 121, the controller 121 may be configured to determine a first position of the edge 119 of the substrate 103 based on initial data related to the position of the edge 119 of the substrate 103, and any change in the detected position of the edge 119 of the substrate 103 as the substrate 103 is fed through the spreader system 111 in the process direction 105 may be determined to indicate that the substrate 103 is tracking in a direction different from the process direction 105 and is accordingly misaligned.

According to various embodiments, the spreader system 111 comprises a spreader nip loading mechanism 125 that induces one or more loads by way of two or more loading devices 127 and 129 to cause the formation of the spreader nip (illustrated in FIG. 2) to spread the ink applied to the substrate 103 by the print tower 101 as the substrate 103 is fed through the spreader system 111. The loading devices 127 and 129 are positioned at an inboard side 131 of the spreader nip and an outboard side of the spreader nip 133, respectively. Accordingly, loading device 127 is an inboard loading device and loading device 129 is an outboard loading device. The spreader nip has a pressure profile formed across its width that is based on the loads induced by the inboard loading device 127 and the outboard loading device 129.

As will be illustrated and discussed in more detail below with respect to FIG. 2, the spreader system 111 forms the spreader nip between a roller pair comprising roller 135 and another roller (illustrated in FIG. 2). The roller pair, as discussed above, may comprise a spreader drum that is a hard roller and a pressure roll that conforms to the surface of the spreader drum. The roller 135 may be the pressure roll or the spreader drum of the roller pair, and the other roller may be the other of the pressure roll and the spreader drum of the roller pair.

In one or more embodiments, to facilitate balancing of the pressure profile of the spreader nip, the controller 121 intentionally causes the spreader nip loading mechanism 125 to bias the loading that causes the spreader nip be formed to one of the inboard side 131 and the outboard side 133 of the spreader nip. For example, the spreader nip loading mechanism 125 applies a load to both the inboard side 131 and outboard side 133 of the spreader nip. In one embodiment, the loads applied may be equal, while in other embodiments, the loads may be unequal. The spreader nip loading mechanism 125 then fixes one of the loads applied to the inboard side 131 and the outboard side 133 and biases the loading by causing one of the inboard loading device 127 and the outboard loading device 129 to apply a variable load that continually increases to the other of the inboard side 131 and outboard side 133 of the spreader nip until the media edge position sensor 117 indicates data that causes the controller 121 to determine that the substrate 103 is misaligned from the process direction 105 based on a detected web-tracking movement to one of the inboard side 131 and the outboard side 133 of the spreader nip.

Figure 6:
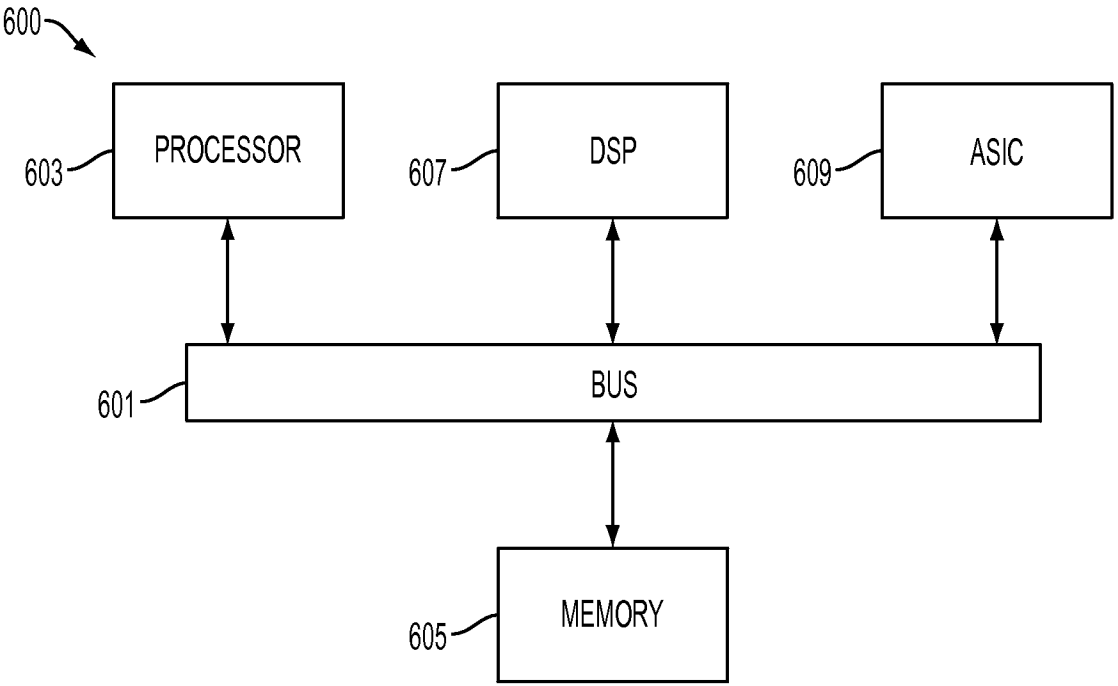
FIG. 6 is a diagram of a chip set that can be used to implement an embodiment.

The controller 121 records a location at which the substrate 103 is caused to track to the one of the inboard side 131 and the outboard side 133 of the spreader nip, as well as the load condition (i.e. the value of the load induced by the inboard loading device 127 or the outboard loading device 129) at the time the substrate 103 is caused to track to the one of the inboard side 131 and the outboard side 133 of the spreader nip in a memory associated with the controller 121 (for example the memory 605 illustrated and discussed with regard to FIG. 6 below).

The controller 121 then causes the spreader nip loading mechanism 125 to fix the other of the loads applied to the inboard side 131 and the outboard side 133 and biases the loading by causing the of the other of the inboard loading device 127 and the outboard loading device 129 (i.e., the loading device opposite from the side used in previous step) to apply a variable load that continually increases to the one of the inboard side 131 and the outboard side 133 that was previous the subject of the fixed load. Again, this variable loading is caused to continually increase until the media edge position sensor 117 indicates data that causes the controller 121 to determine that the substrate 103 is misaligned from the process direction 105 based on a detected web-tracking movement to the other of the one of the inboard side 131 and the outboard side 133 of the spreader nip.

The controller 121 again records the location and loading condition at which the substrate 103 is caused to track to the other of the inboard side 131 and the outboard side 133 of the spreader nip. Based on any combination of the determined locations of misaligned substrate 103 tracking and loading conditions that cause the misaligned tracking, the determined dimensions of the substrate 103, the determined centerline 123 of the process direction 105, any deviation from a determined first position of the edge 119 of the substrate 103, and any determined offset that the substrate 103 is positioned from the centerline 123, etc., the controller 121 determines balanced load values for each of the inboard loading device 127 and outboard loading device 129 such that the pressure profile in the spreader nip is balanced and uniform regardless of spreader nip geometry, substrate type, substrate size, position of the substrate 103 in the system 100 (e.g., a determined offset from the centerline 123), etc.

Accordingly, the spreader nip loading mechanism 125 that controls the load induced by the inboard loading device 127 and the outboard loading device 129 applies the balancing loads determined by the controller 121. The balancing loads may be equal or different loads applied to the inboard side 131 and the outboard side 133 of the spreader nip.

In one embodiment, the inboard and outboard balancing loads applied by the inboard loading device 127 and the outboard loading device 129 are set based on one of the median or average value between the biased loading values determined to cause the substrate 103 to track toward the inboard side 131 and/or outboard side 133 of the spreader nip and the respective fixed loads of the same inboard side 131 and the outboard side 133.

Consequently, regardless of whether a same or different balancing load is applied by the inboard loading device 127 and the outboard loading device 129, the substrate 103 is caused to track in an aligned fashion with the process direction 105, either along the centerline 123, or at least parallel to the centerline 123, or a different determined centerline, as discussed above, based on the determined dimensions of the substrate 103, for example, or any other line associated with the process direction 105. In addition to straight, aligned tracking through the spreader nip, ink squish or spread is also caused to be uniform across the width of the spreader nip.

Figure 2:
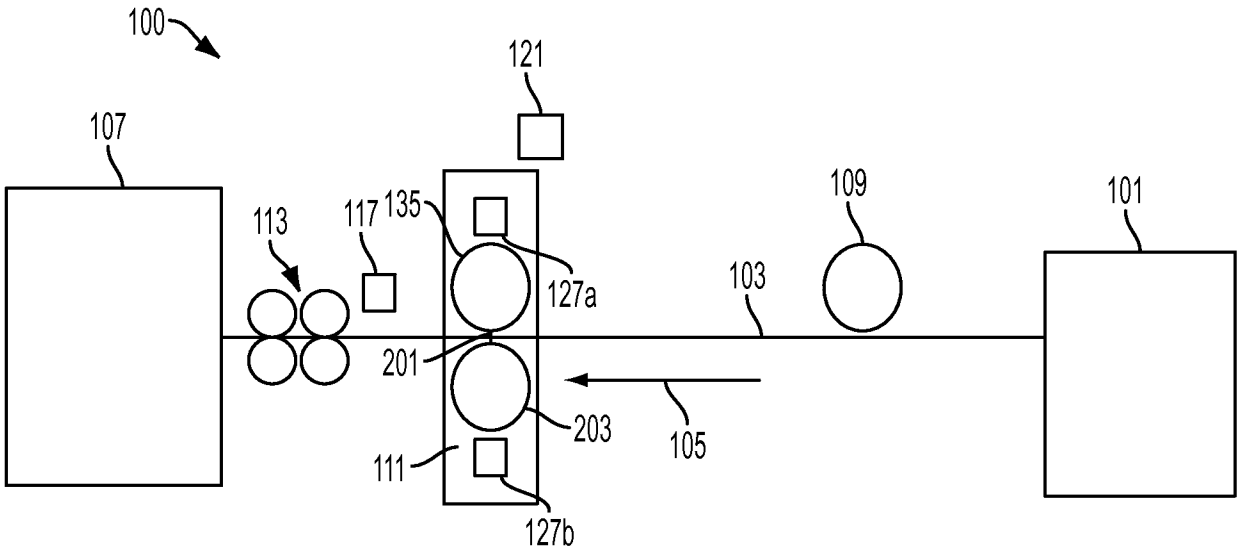
FIG. 2 is a side-view diagram of a system capable of balancing the pressure profile of a spreader nip in a manner that is closed-loop and insensitive to spreader nip geometry, according to one embodiment.

FIG. 2 is a side view of the system 100 from the inboard side 131 perspective described above in FIG. 1. From this view, the spreader nip 201 can be seen as being inside the spreader system 111. The spreader system 111 is illustrated as being a box in this diagram, but it should be noted that the spreader nip 201 need not be encapsulated within any physical form and may merely exist between the roller pair comprising roller 135 and the other roller 203. As discussed above, the roller 135 may be any of a pressure roll or a spreader drum, and the other roller 203 may be the other of the pressure roll and the spreader drum.

In one or more embodiments, the inboard loading device 127 discussed above may be comprised of one or more upper and lower inboard loading devices 127*a* and 127*b* that are configured to induce a load to either or both of the roller 135 and the other roller 203. Similarly, though not shown, the outboard loading device 129 discussed above may have the same or different configuration. The system 100 may include any number of upper and lower loading devices, and may choose to have a load selectively applied and any upper and lower loading devices need not be operated simultaneously even if they are present.

For example, when the controller 121 causes the inboard loading device 127 and the outboard loading device 129 to induce a load that causes the spreader nip 201, the upper and lower loading devices 127*a* and 127*b* (and similarly upper and lower loading devices associated with the outboard loading device 129) may simultaneously apply a same or different load to their respective roller to cause the spreader nip 201, and the appropriate pressure profile. Additionally, any combination of inboard and outboard loading devices 127, 129 may be included in the system 100, and any position of the inboard and outboard loading devices 127, 129 are possible. For example, the inboard and outboard loading devices 127, 129 may both be positioned to induce a load onto the roller 135, or they both may be positioned to induce a load onto the roller 203. Alternatively, the inboard and outboard loading devices may be positioned to induce a load such that the inboard loading device 127 applies a load to the roller 135 and the outboard loading device 129, discussed above, applies a load to the other roller 203, or vice versa. Or, one of the inboard side 131 and the outboard side 133 of the spreader nip 201 discussed above may have the upper and lower loading devices 127 (127*a* and 127*b* illustrated in FIG. 2), 129 (respective upper and lower loading devices not shown) positioned accordingly, while the other of the inboard side 131 or the outboard side 133 may have only one loading device positioned to apply a load to one of the roller 135 or the other roller 203.

Figure 3:
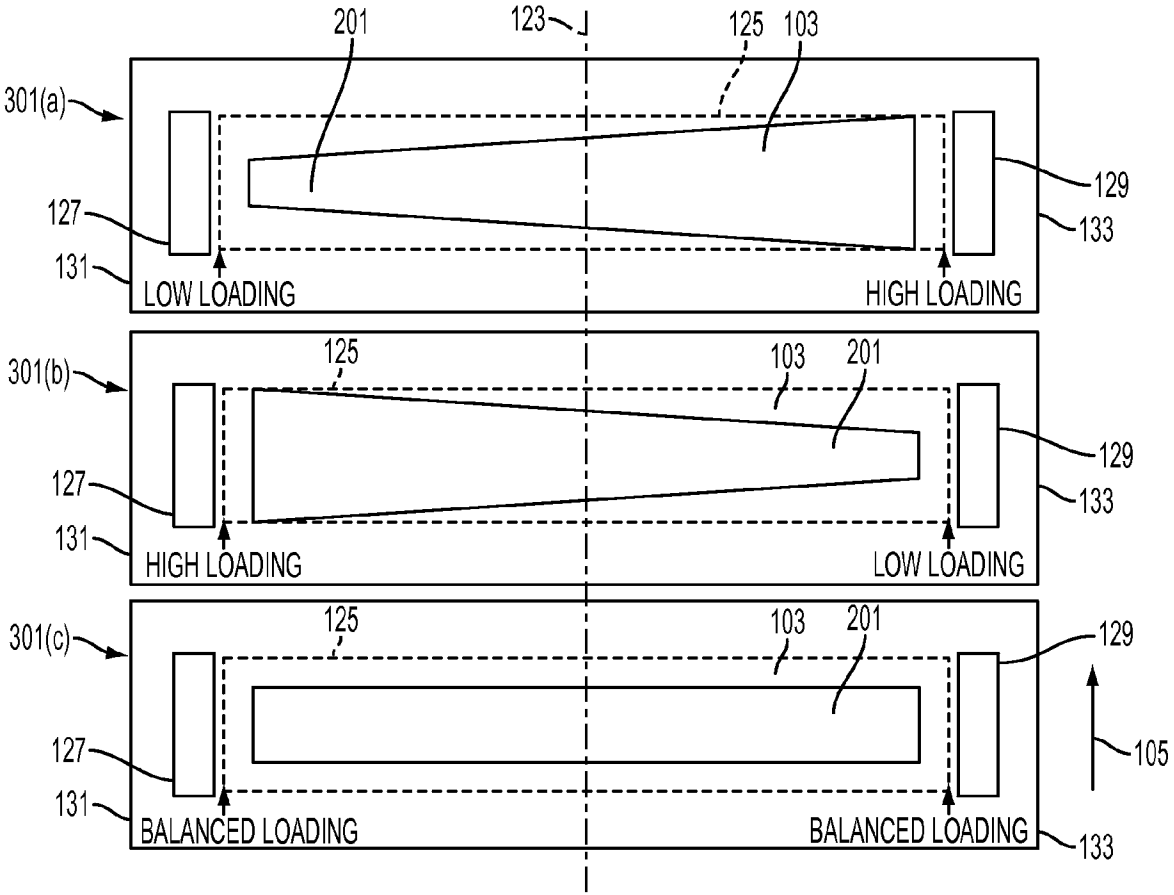
FIG. 3 is top view of a method for balancing the pressure profile of a spreader nip in a manner that is closed-loop and insensitive to spreader nip geometry, according to one embodiment.

FIG. 3 illustrates a top-side view of example changes in spreader nip 201 pressure profiles 301(*a*), 301(*b*), and 301(*c*) as the spreader nip loading mechanism 125 discussed above causes the inboard loading device 127 and the outboard loading device 129 to bias their respective loads. The spreader nip loading mechanism 125 biases the inboard and outboard loads applied by the inboard and outboard loading devices 127, 129 by continually adjusting their loads to determine a balancing load. The balancing load, as discussed above, is a load that results in a uniform pressure profile 301(*c*) across the width of spreader nip 201 in a portion of the spreader nip 201 through which the substrate 103 is fed. FIG. 3 illustrates a uniform pressure profile 301(*c*) that results for a substrate 103, discussed above, that is centered along the centerline 123 of the process direction 105.

For example, when the loading induced by the spreader nip loading mechanism 125 discussed above is heavily biased toward the outboard side 133 of the spreader nip 201 by causing the outboard loading device 129 to apply a load that gradually increases to a value greater than a fixed load applied by the inboard loading device 127, the outboard biased nip pressure profile 301*a* is formed. The outboard biased nip pressure profile 301*a* is non-symmetric and drives the substrate 103 towards the inboard side 131 of the spreader nip 201. The media edge position sensor 117, discussed above, detects the first signs of movement of the edge 119 of the substrate 103 toward the inboard side 131 of the spreader nip 201 as the biased load continually increases. The controller 121 stops the load biasing and records one or more of the inboard and outboard load values applied by the inboard loading device 127 and the outboard loading device 129 at the time the movement of the edge 119 of the substrate 103 is determined to track toward the inboard side 131 of the spreader nip 201.

Then, the loading induced by the spreader nip loading mechanism 125 discussed above is heavily biased toward the inboard side 131 of the spreader nip 201 by causing the inboard board loading device 127 to apply a load that gradually increases to a value greater than a fixed load applied by the outboard loading device 129, the inboard biased nip pressure profile 301*b* is formed. The inboard biased nip pressure profile 301*b* is non-symmetric and drives the substrate 103 toward the outboard side 133 of the spreader nip 201. The media edge position sensor 117, discussed above, detects the first signs of movement of the edge 119 of the substrate 103 towards the outboard side 133 of the spreader nip 201 as the biased load continually increases. The controller 121 stops the load biasing and records one or more of the inboard and outboard load values applied by the inboard loading device 127 and the outboard loading device 129 at the time the movement of the edge 119 of the substrate 103 is determined to track toward the outboard side 133 of the spreader nip 201.

Next, the controller 121, as discussed above, takes the fixed load value applied to the inboard side 131 of the spreader nip 201 and the value applied to the inboard side 131 of the spreader nip 201 that causes the substrate 103 to move toward the outboard side 133 of the spreader nip, takes one of the median and average of these values, and determines the average or median value to be the balancing load for the inboard side 131 that is to be applied by the inboard loading device 127, as discussed above. Similarly, the controller 121, as discussed above, takes the fixed load value applied to the outboard side 133 of the spreader nip 201 and the value applied to the outboard side 133 of the spreader nip 201 that causes the substrate 103 to move toward the inboard side 131 of the spreader nip, takes one of the median and average of these values, and determines the average or median value to be the balancing load for the outboard side 133 that is to be applied by the outboard loading device 129, as discussed above. The controller 121 then causes the spreader nip loading mechanism 125 to cause the inboard loading device 127 and the outboard loading device 129 to apply their respective balancing loads to cause the substrate 103 to track in a direction parallel to the centerline 123 and cause the uniform nip pressure profile 301(*c*).

Figure 4:
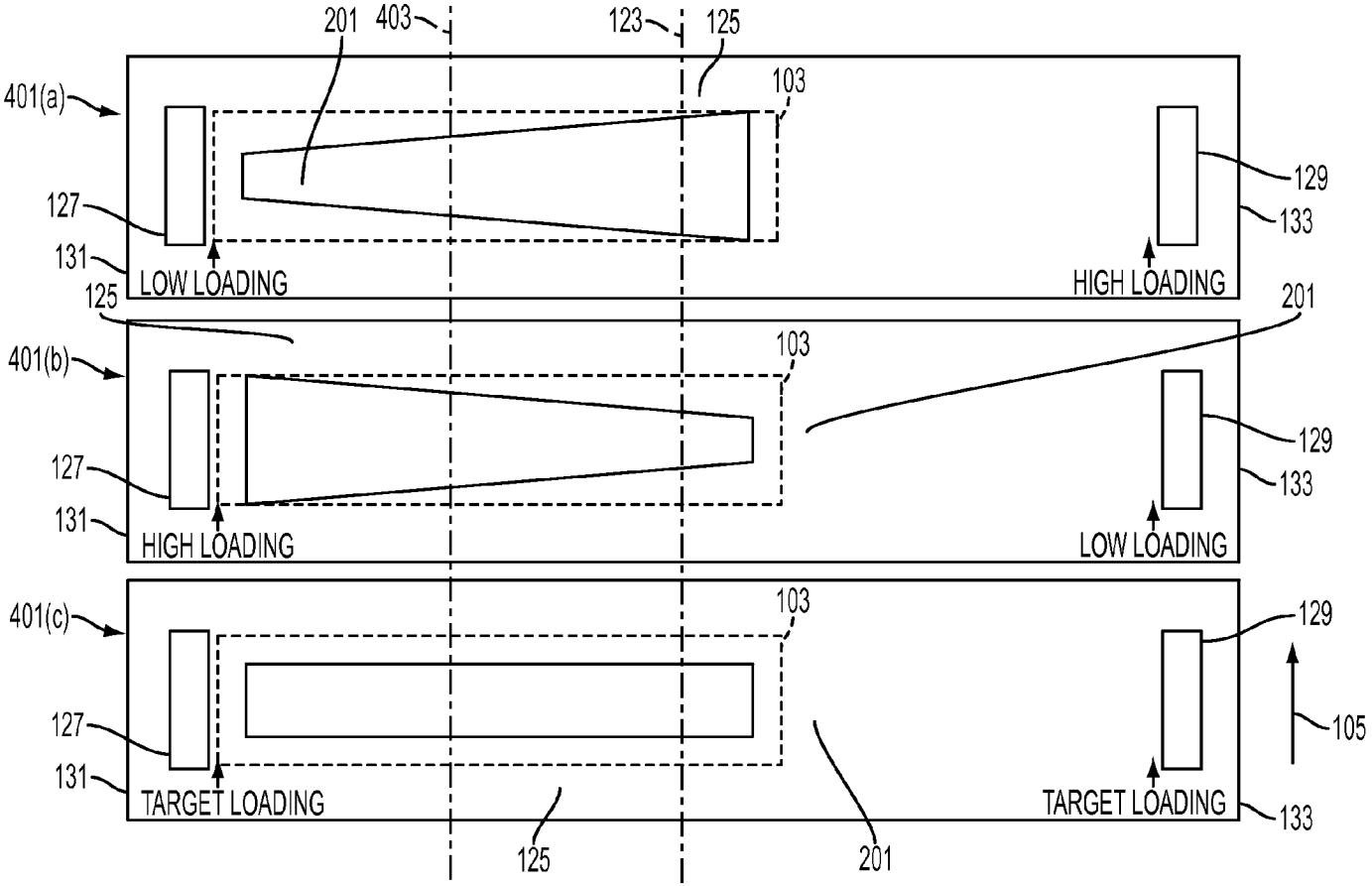
FIG. 4 top view of a method for balancing the pressure profile of a spreader nip in a manner that is closed-loop and insensitive to spreader nip geometry for a substrate that is offset, according to one embodiment.

FIG. 4 illustrates a top-side view of example changes in spreader nip 201 pressure profiles 401(*a*), 401(*b*), and 401(*c*) as the spreader nip loading mechanism 125 discussed above causes the inboard loading device 127 and the outboard loading device 129 to bias their respective loads. The spreader nip loading mechanism 125 biases the inboard and outboard loads applied by the inboard and outboard loading devices 127, 129 by continually adjusting their loads to determine a balancing load. The balancing load, as discussed above, is a load that results in a uniform pressure profile 401(*c*) across the width of spreader nip 201 in a portion of the spreader nip 201 through which the substrate 103 is fed. FIG. 4 illustrates a uniform pressure profile 401(*c*) that results for a substrate 103, discussed above, that is not aligned with the centered the centerline 123 of the process direction 105, but is rather offset from the centerline 123, partially because of the substrate 103 having a width that is less than the width of the spreader nip 201 as a whole. FIG. 4 also illustrates that the substrate 103 may be caused to be aligned based on an edge 119 alignment with the inboard side 131 of the spreader nip 201, rather than a determination that the substrate 103 is centered within the system 100, discussed above.

For example, when the loading induced by the spreader nip loading mechanism 125 discussed above is heavily biased toward the outboard side 133 of the spreader nip 201 by causing the outboard loading device 129 to apply a load that gradually increases to a value greater than a fixed load applied by the inboard loading device 127, the outboard biased nip pressure profile 401*a* is formed. The outboard biased nip pressure profile 401*a* is non-symmetric and drives the substrate 103 towards the inboard side 131 of the spreader nip 201. The media edge position sensor 117, discussed above, detects the first signs of movement of the edge 119 of the substrate 103 toward the inboard side 131 of the spreader nip 201 as the biased load continually increases. The controller 121 stops the load biasing and records one or more of the inboard and outboard load values applied by the inboard loading device 127 and the outboard loading device 129 at the time the movement of the edge 119 of the substrate 103 is determined to track toward the inboard side 131 of the spreader nip 201.

Then, the loading induced by the spreader nip loading mechanism 125 discussed above is heavily biased toward the inboard side 131 of the spreader nip 201 by causing the inboard board loading device 127 to apply a load that gradually increases to a value greater than a fixed load applied by the outboard loading device 129, the inboard biased nip pressure profile 401*b* is formed. The inboard biased nip pressure profile 401*b* is non-symmetric and drives the substrate 103 toward the outboard side 133 of the spreader nip 201. The media edge position sensor 117, discussed above, detects the first signs of movement of the edge 119 of the substrate 103 towards the outboard side 133 of the spreader nip 201 as the biased load continually increases. The controller 121 stops the load biasing and records one or more of the inboard and outboard load values applied by the inboard loading device 127 and the outboard loading device 129 at the time the movement of the edge 119 of the substrate 103 is determined to track toward the outboard side 133 of the spreader nip 201.

Next, the controller 121, as discussed above, takes the fixed load value applied to the inboard side 131 of the spreader nip 201 and the value applied to the inboard side 131 of the spreader nip 201 that causes the substrate 103 to move toward the outboard side 133 of the spreader nip, takes one of the median and average of these values, and determines the average or median value to be the balancing load for the inboard side 131 that is to be applied by the inboard loading device 127, as discussed above. Similarly, the controller 121, as discussed above, takes the fixed load value applied to the outboard side 133 of the spreader nip 201 and the value applied to the outboard side 133 of the spreader nip 201 that causes the substrate 103 to move toward the inboard side 131 of the spreader nip, takes one of the median and average of these values, and determines the average or median value to be the balancing load for the outboard side 133 that is to be applied by the outboard loading device 129, as discussed above. The controller 121 then causes the spreader nip loading mechanism 125 to cause the inboard loading device 127 and the outboard loading device 129 to apply their respective balancing loads to cause the substrate 103 to track in a direction parallel to the centerline 123, which may or may not be along the other centerline 403, or at least in a direction parallel to the determined alignment of the edge 119 with the inboard side 131, and cause the uniform nip pressure profile 401(*c*) for a substrate 103 that is offset from the centerline 123 as determined based, at least in part, on the one or more dimensions of the substrate 103.

Figure 5:
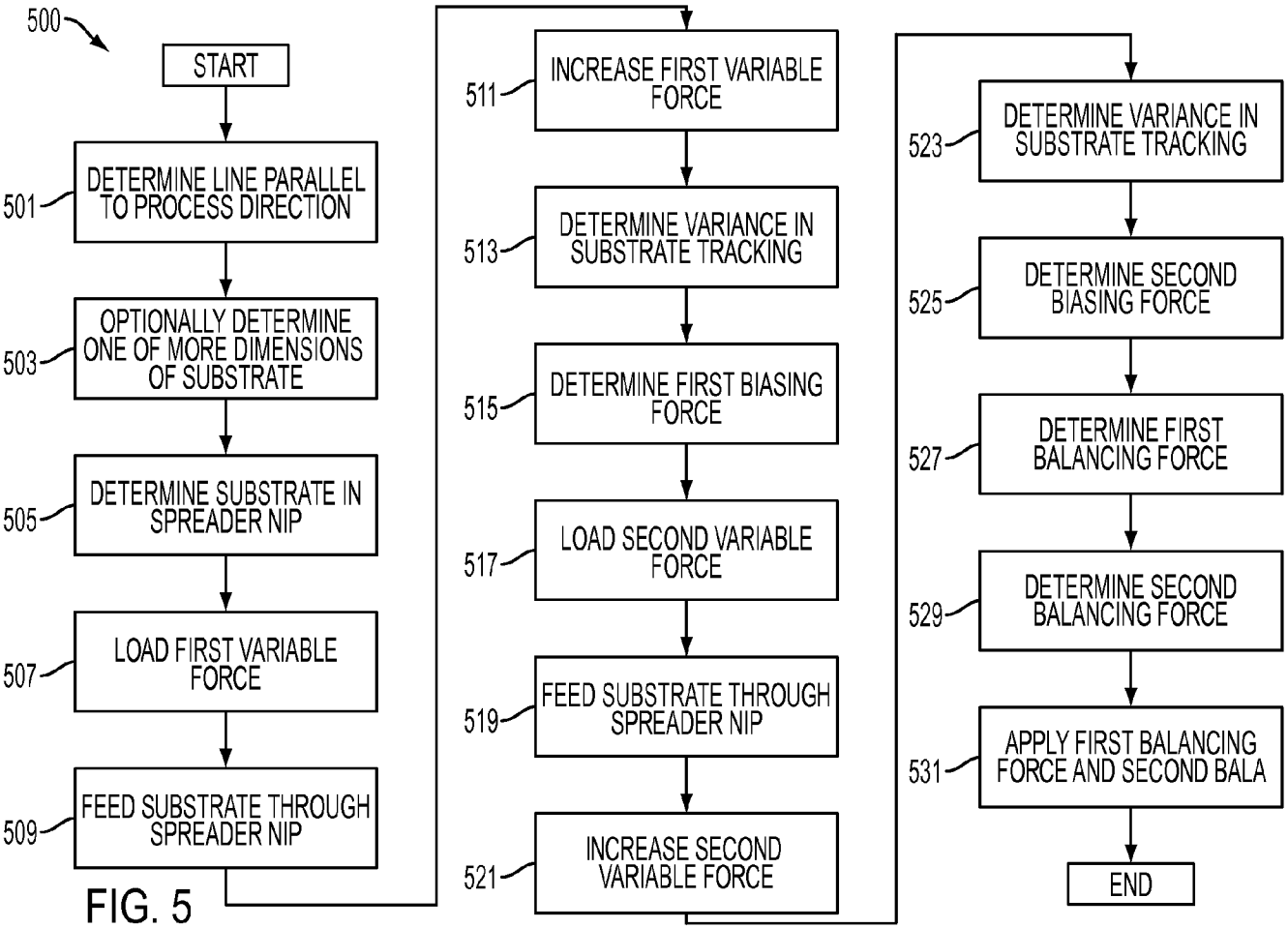
FIG. 5 is a flowchart of a process for balancing the pressure profile of a spreader nip in a manner that is closed-loop and insensitive to spreader nip geometry, according to one embodiment.

FIG. 5 is a flowchart of a process for balancing the pressure profile of a spreader nip in a manner that is closed-loop and insensitive to spreader nip geometry, according to one embodiment. In one embodiment, the controller 121 discussed above performs the process 500 and may incorporate, for instance, a chip set including a processor and a memory as shown in FIG. 6. In step 501, the controller 121 determines a line parallel to a target process direction. Then, in step 503, the controller may optionally determine one or more dimensions of the substrate, and the line parallel to the target process direction may be a centerline of the target process direction with respect to the one or more dimensions of the substrates, or a centerline of the process direction that is centered along a media path of the system 100, discussed above.

Then, in step 505, the controller 121 determines the presence of a substrate positioned between the first roller and the second roller in the spreader nip. Next, in step 507, the controller 121 causes, at least in part, one of an inboard side and an outboard side of the spreader nip to be loaded with a first variable force. Then, in step 509, the controller 121 causes, at least in part, the substrate to be fed through the spreader nip while the one of the inboard side and the outboard side of the spreader nip is loaded with the first variable force.

The process continues to step 511 in which the controller 121 causes, at least in part, the first variable force to increase as the substrate is fed through the spreader nip. Then, in step 513, the controller 121 determines, by way of a sensor, the substrate is caused to track to one of the inboard side and the outboard side of the spreader nip as the first variable force is caused to increase. According to various embodiments, the controller 121 may also cause, at least in part, the other of the inboard side and the outboard side of the spreader nip to be loaded with a first fixed force when the one of the inboard side and the outboard side of the spreader nip is loaded with the first variable force.

Next, in step 515, the controller 121 determines a first biasing force to be equal to a value of the first variable force that causes the substrate to track to the one of the inboard side and the outboard side of the spreader nip. The first biasing force, in one or more embodiments, may be stored in a memory associated with the controller 121.

The process continues to step 517 in which the controller 121 causes, at least in part, the other one of the inboard side and the outboard side of the spreader nip to be loaded with a second variable force. Then, in step 519, the controller 121 causes, at least in part, the substrate to be fed through the spreader nip while the other of the inboard side and the outboard side of the spreader nip is loaded with the second variable force. According to various embodiments, the controller 121 may also cause, at least in part, the one of the inboard side and the outboard side of the spreader nip to be loaded with a second fixed force when the other of the inboard side and the outboard side of the spreader nip is loaded with the second variable force.

Next, in step 521, the controller 121 causes, at least in part, the second variable force to increase as the substrate is fed through the spreader nip. Then, in step 523, the controller 121 determines, by way of the sensor, the substrate is caused to track to the other of the inboard side and the outboard side of the spreader nip as the second variable force is caused to increase. The process continues to step 525 in which the controller 121 determines a second biasing force to be equal to a value of the second variable force that causes the substrate to track to the other of the inboard side and the outboard side of the spreader nip. The second biasing force, in one or more embodiments, may be stored in a memory associated with the controller 121.

Next, in step 527, the controller 121 determines a first balancing force based, at least in part, on the first biasing force. For example, the controller 121 may determine a first median value of the first biasing force and the second fixed force. Then, in step 529, the controller 121 determines a second balancing force based, at least in part, on the second biasing force. For example, the controller 121 may determine a second median value of the second biasing force and the first fixed force.

Then, in step 531, the controller 121 causes, at least in part, the inboard side of the spreader nip to be loaded by one of the first balancing force and the second balancing force and the outboard side of the spreader nip to be loaded by the other of the first balancing force and the second balancing force to cause the substrate to track in a direction such that a side edge of the substrate is caused to track parallel to the line parallel to the target process direction. According to various embodiments, the controller 121 may cause, at least in part, the first balancing force to be equal to the first median value and the second balancing force to be equal to the second median value. As discussed above, the first and second balancing forces may be equal or unequal values depending on the various determinations made throughout the process 500.

The processes described herein for balancing the pressure profile of a spreader nip in a manner that is closed-loop and insensitive to spreader nip geometry may be advantageously implemented via software, hardware, firmware or a combination of software and/or firmware and/or hardware. For example, the processes described herein, may be advantageously implemented via processor(s), Digital Signal Processing (DSP) chip, an Application Specific Integrated Circuit (ASIC), Field Programmable Gate Arrays (FPGAs), etc. Such exemplary hardware for performing the described functions is detailed below.

FIG. 6 illustrates a chip set or chip 600 upon which an embodiment may be implemented. Chip set 600 is programmed to balance the pressure profile of a spreader nip in a manner that is closed-loop and insensitive to spreader nip geometry as described herein may include, for example, bus 601, processor 603, memory 605, DSP 607 and ASIC 609 components.

The processor 603 and memory 605 may be incorporated in one or more physical packages (e.g., chips). By way of example, a physical package includes an arrangement of one or more materials, components, and/or wires on a structural assembly (e.g., a baseboard) to provide one or more characteristics such as physical strength, conservation of size, and/or limitation of electrical interaction. It is contemplated that in certain embodiments the chip set 600 can be implemented in a single chip. It is further contemplated that in certain embodiments the chip set or chip 600 can be implemented as a single "system on a chip." It is further contemplated that in certain embodiments a separate ASIC would not be used, for example, and that all relevant functions as disclosed herein would be performed by a processor or processors. Chip set or chip 600, or a portion thereof, constitutes a means for performing one or more steps of balancing the pressure profile of a spreader nip in a manner that is closed-loop and insensitive to spreader nip geometry.

In one or more embodiments, the chip set or chip 600 includes a communication mechanism such as bus 601 for passing information among the components of the chip set 600. Processor 603 has connectivity to the bus 601 to execute instructions and process information stored in, for example, a memory 605. The processor 603 may include one or more processing cores with each core configured to perform independently. A multi-core processor enables multiprocessing within a single physical package. Examples of a multi-core processor include two, four, eight, or greater numbers of processing cores. Alternatively or in addition, the processor 603 may include one or more microprocessors configured in tandem via the bus 601 to enable independent execution of instructions, pipelining, and multithreading. The processor 603 may also be accompanied with one or more specialized components to perform certain processing functions and tasks such as one or more digital signal processors (DSP) 607, or one or more application-specific integrated circuits (ASIC) 609. A DSP 607 typically is configured to process real-world signals (e.g., sound) in real time independently of the processor 603. Similarly, an ASIC 609 can be configured to performed specialized functions not easily performed by a more general purpose processor. Other specialized components to aid in performing the inventive functions described herein may include one or more field programmable gate arrays (FPGA), one or more controllers, or one or more other special-purpose computer chips.

In one or more embodiments, the processor (or multiple processors) 603 performs a set of operations on information as specified by computer program code related to balancing the pressure profile of a spreader nip in a manner that is closed-loop and insensitive to spreader nip geometry. The computer program code is a set of instructions or statements providing instructions for the operation of the processor and/or the computer system to perform specified functions. The code, for example, may be written in a computer programming language that is compiled into a native instruction set of the processor. The code may also be written directly using the native instruction set (e.g., machine language). The set of operations include bringing information in from the bus 601 and placing information on the bus 601. The set of operations also typically include comparing two or more units of information, shifting positions of units of information, and combining two or more units of information, such as by addition or multiplication or logical operations like OR, exclusive OR (XOR), and AND. Each operation of the set of operations that can be performed by the processor is represented to the processor by information called instructions, such as an operation code of one or more digits. A sequence of operations to be executed by the processor 603, such as a sequence of operation codes, constitute processor instructions, also called computer system instructions or, simply, computer instructions. Processors may be implemented as mechanical, electrical, magnetic, optical, chemical or quantum components, among others, alone or in combination.

The processor 603 and accompanying components have connectivity to the memory 605 via the bus 601. The memory 605 may include one or more of dynamic memory (e.g., RAM, magnetic disk, writable optical disk, etc.) and static memory (e.g., ROM, CD-ROM, etc.) for storing executable instructions that when executed perform the inventive steps described herein to balance the pressure profile of a spreader nip in a manner that is closed-loop and insensitive to spreader nip geometry. The memory 605 also stores the data associated with or generated by the execution of the inventive steps.

In one or more embodiments, the memory 605, such as a random access memory (RAM) or any other dynamic storage device, stores information including processor instructions for balancing the pressure profile of a spreader nip in a manner that is closed-loop and insensitive to spreader nip geometry. Dynamic memory allows information stored therein to be changed by system 100. RAM allows a unit of information stored at a location called a memory address to be stored and retrieved independently of information at neighboring addresses. The memory 605 is also used by the processor 603 to store temporary values during execution of processor instructions. The memory 605 may also be a read only memory (ROM) or any other static storage device coupled to the bus 601 for storing static information, including instructions, that is not changed by the system 100. Some memory is composed of volatile storage that loses the information stored thereon when power is lost. The memory 605 may also be a non-volatile (persistent) storage device, such as a magnetic disk, optical disk or flash card, for storing information, including instructions, that persists even when the system 100 is turned off or otherwise loses power.

The term "computer-readable medium" as used herein refers to any medium that participates in providing information to processor 603, including instructions for execution. Such a medium may take many forms, including, but not limited to computer-readable storage medium (e.g., non-volatile media, volatile media), and transmission media. Non-volatile media includes, for example, optical or magnetic disks. Volatile media include, for example, dynamic memory. Transmission media include, for example, twisted pair cables, coaxial cables, copper wire, fiber optic cables, and carrier waves that travel through space without wires or cables, such as acoustic waves and electromagnetic waves, including radio, optical and infrared waves. Signals include man-made transient variations in amplitude, frequency, phase, polarization or other physical properties transmitted through the transmission media. Common forms of computer-readable media include, for example, a floppy disk, a flexible disk, hard disk, magnetic tape, any other magnetic medium, a CD-ROM, CDRW, DVD, any other optical medium, punch cards, paper tape, optical mark sheets, any other physical medium with patterns of holes or other optically recognizable indicia, a RAM, a PROM, an EPROM, a FLASH-EPROM, an EEPROM, a flash memory, any other memory chip or cartridge, a carrier wave, or any other medium from which a computer can read. The term computer-readable storage medium is used herein to refer to any computer-readable medium except transmission media.

While a number of embodiments and implementations have been described, the invention is not so limited but covers various obvious modifications and equivalent arrangements, which fall within the purview of the appended claims. Although features of various embodiments are expressed in certain combinations among the claims, it is contemplated that these features can be arranged in any combination and order.

What is claimed is:

1. A method for balancing a pressure profile of a spreader nip formed by a first roller and a second roller within a print system, the method comprising:

determining a line parallel to a target process direction;

determining the presence of a substrate positioned between the first roller and the second roller in the spreader nip;

causing, at least in part, one of an inboard side and an outboard side of the spreader nip to be loaded with a first variable force;

causing, at least in part, the substrate to be fed through the spreader nip while the one of the inboard side and the outboard side of the spreader nip is loaded with the first variable force;

causing, at least in part, the first variable force to increase as the substrate is fed through the spreader nip;

determining, by way of a sensor, the substrate is caused to track to one of the inboard side and the outboard side of the spreader nip as the first variable force is caused to increase;

determining a first biasing force to be equal to a value of the first variable force that causes the substrate to track to the one of the inboard side and the outboard side of the spreader nip;

causing, at least in part, the other one of the inboard side and the outboard side of the spreader nip to be loaded with a second variable force;

causing, at least in part, the substrate to be fed through the spreader nip while the other of the inboard side and the outboard side of the spreader nip is loaded with the second variable force;

causing, at least in part, the second variable force to increase as the substrate is fed through the spreader nip;

determining, by way of the sensor, the substrate is caused to track to the other of the inboard side and the outboard side of the spreader nip as the second variable force is caused to increase;

determining a second biasing force to be equal to a value of the second variable force that causes the substrate to track to the other of the inboard side and the outboard side of the spreader nip;

determining a first balancing force based, at least in part, on the first biasing force;

determining a second balancing force based, at least in part, on the second biasing force; and causing, at least in part, the inboard side of the spreader nip to be loaded by one of the first balancing force and the second balancing force and the outboard side of the spreader nip to be loaded by the other of the first balancing force and the second balancing force to cause the substrate to track in a direction such that a side edge of the substrate is caused to track parallel to the line parallel to the target process direction.

2. A method of claim 1, further comprising:

causing, at least in part, the other of the inboard side and the outboard side of the spreader nip to be loaded with a first fixed force when the one of the inboard side and the outboard side of the spreader nip is loaded with the first variable force;

causing, at least in part, the one of the inboard side and the outboard side of the spreader nip to be loaded with a second fixed force when the other of the inboard side and the outboard side of the spreader nip is loaded with the second variable force;

determining a first median value of the first biasing force and the second fixed force;

determining a second median value of the second biasing force and the first fixed force; and causing, at least in part, the first balancing force to be equal to the first median value and the second balancing force to be equal to the second median value.

3. A method of claim 1, further comprising:

determining one or more dimensions of the substrate, wherein the line parallel to the target process direction is a centerline of the target process direction with respect to the one or more dimensions of the substrate.

4. A method of claim 1, wherein the first balancing force and the second balancing force are different values.

5. A method of claim 1, wherein the first balancing force and the second balancing force are equal values.

6. A method of claim 1, further comprising:

causing, at least in part, the first biasing force and the second biasing force to be saved in a memory.

7. A method of claim 1, wherein the first variable force and the second variable force are applied to the inboard side and the outboard side of the first roller.

8. A method of claim 1, wherein the first variable force and the second variable force are applied to the inboard side and the outboard side of the second roller.

9. A method of claim 1, wherein the first variable force is caused by simultaneously loading the first roller and the second roller with their own respective first variable force causing loads and the second variable force is caused by simultaneously loading the first roller and the second roller with the own respective second variable force causing loads.

10. A method of claim 1, wherein the first variable force is applied to one of the inboard side and the outboard side of one of the first roller and the second roller and the second variable force is applied to the other of the inboard side and the outboard side of the other of the first roller and the second roller.

* * * * *